United States Patent [19]

Abe

[11] Patent Number: 4,607,832

[45] Date of Patent: Aug. 26, 1986

[54] ENDLESS BELT SEPARATOR HAVING AN UNSUPPORTED SEPARATING SURFACE

[75] Inventor: Masahiro Abe, Himeji, Japan

[73] Assignee: Glory Kogyo Kabushiki Kaisha, Himeji, Japan

[21] Appl. No.: 710,811

[22] Filed: Mar. 12, 1985

[30] Foreign Application Priority Data

Jan. 31, 1985 [JP] Japan ..... 50-12418[U]

[51] Int. Cl.[4] ..... B65H 3/04

[52] U.S. Cl. ..... 271/10; 271/35; 271/160; 271/165; 221/218

[58] Field of Search ..... 271/10, 12, 34, 35, 271/302, 125, 124, 122, 121, 109, 119, 160, 165; 221/217, 218, 223, 260, 253, 160; 198/689

[56] References Cited

U.S. PATENT DOCUMENTS 3,593,988 7/1971 Collins ..... 271/119 X
3,967,278 10/1975 Jaton ..... 271/35
3,990,694 11/1976 Mason et al. ..... 271/125 X
4,295,737 10/1981 Silverberg ..... 198/689 X
4,431,175 2/1984 Smith ..... 271/34 X

*Primary Examiner*—Bruce H. Stoner, Jr.
*Assistant Examiner*—Matthew C. Graham
*Attorney, Agent, or Firm*—Beveridge, DeGrandi & Weilacher

[57] ABSTRACT

A delivery device in which an endless belt rotatably driven is brought into contact with the foremost sheet of a stack of sheets of paper stored in a registered relationship with each other and the sheets of paper are delivered one at a time by the endless belt through a gate gap defined by a rotary member which guides the endless belt and a gate forming member disposed in opposed relationship with the rotary member. The sheets of paper can be delivered one at a time in a predetermined spaced apart relationship by utilizing the slack of the endless belt.

6 Claims, 18 Drawing Figures

ENDLESS BELT SEPARATOR HAVING AN UNSUPPORTED SEPARATING SURFACE

BACKGROUND OF THE INVENTION

The present invention relates to a delivery device for delivering sheets of paper one at a time by the frictional contact with the front sheet of a stack of sheets of paper which are stored in an aligned or registered relationship.

In a delivery device for taking out sheets one at a time from a stack of sheets of paper stored in an aligned or registered relationship to carry out the processes of counting, discriminating, discharging or the like of sheets of paper such as bank notes, in general a friction roller is brought into frictional contact with the surface of the front sheet and the sheets are delivered by the rotation of the friction roller one at a time.

When the friction roller is used to deliver the sheets as described above, each sheet contacts tangentially the peripheral surface of the friction roller. Therefore, there arises no serious problem in the case of new bank notes because they have uniform surfaces, respectively, but in the case of used bank notes having wrinkles and creases, their surface conditions vary from one to another to cause the bank notes to be slipped and the delivery of them becomes unstable. Especially when the delivered bank notes must be spaced apart from each other by a predetermined distance, the distances between them vary from one to another whereby the successive processes are adversely affected.

In order to ensure the reliable delivery of the sheets, there has been used a delivery device in which a suction head is used to separate one sheet at a time by suction and thereafter the separated sheet is delivered by transport means to the successive processing part of the coin processing machine.

In the case of the delivery device using the suction head described above, it is necessary to cause the suction head to be swung in order to separate the front sheet from the stacked sheets after it is sucked on the sucking surface of the suction head. As a result, there arise the problems that the construction of the delivery device is considerably complicated and that the cost is very expensive because a vacuum pump, a line system for the vacuum pump and associated components such as control valves are required. When the suction head is used, the operation of the control valves becomes inevitably necessary in order to swing and evacuate the suction head. Accordingly, sheet delivery efficiency is inevitably limited.

SUMMARY OF THE INVENTION

In view of the above, the object of the present invention is to provide a sheet delivery device which can deliver even wrinkled and creased sheets of paper in a reliable and dependable manner and which can eliminate complicated mechanisms such as a mechanism for causing a suction head to be swung.

According to the present invention, there is provided a delivery device for pulling sheets of paper one at a time by the frictional contact with the foremost sheet of a stack of sheets of paper stored in registered relationship with each other and delivering the pulled out sheet to a successive device, comprising: (a) an endless belt in contact with the surface of the foremost sheet of a stack of sheets of paper stored in registered relationship with each other; (b) a rotary member which is disposed adjacent to the leading edge of the foremost sheet of said stack of sheets of paper and on which is wound the front end portion of said endless belt; (c) gate forming member means disposed in opposed relationship with said rotary member to define a gate gap for permitting the passage of one sheet of paper between said gate forming member and the outer surface of said endless belt wound on said rotary member; (d) means for maintaining said endless belt in a predetermined posture which forces the rear end portion of said endless belt extended backwardly from the portion of said endless belt wound on said rotary member toward the surface of the foremost sheet of paper in such a way that said rear end portion of said endless belt can be freely deformed and is brought into elastic contact with the surface of said foremost sheet of paper; (e) driving means for driving said endless belt in the direction in which a sheet of paper is delivered; and (f) a transport means disposed downstream of said gate gap for clamping and transporting the sheet of paper delivered by said endless belt; whereby said freely deformable portion of said endless belt extended backwardly of the portion of said endless belt wound on said rotary member is brought into surface contact with the surface of said foremost sheet of paper.

The nature, utility and further features of the present invention will be more clearly apparent from the following detailed description with respect to preferred embodiments of the present invention when read in conjunction with the accompanying drawing briefly described below.

DETAILED DESCRIPTION OF THE INVENTION

An embodiment shown is of the type in which sheets of paper are stacked in such a way that they are aligned with each other in the vertical direction and the undermost sheet is delivered in the lateral direction. Sheets of paper P are stacked on the bottom plate 2 of a paper container 1 and a delivery opening 3 is formed along one side of the bottom plate 2.

Figure 1:
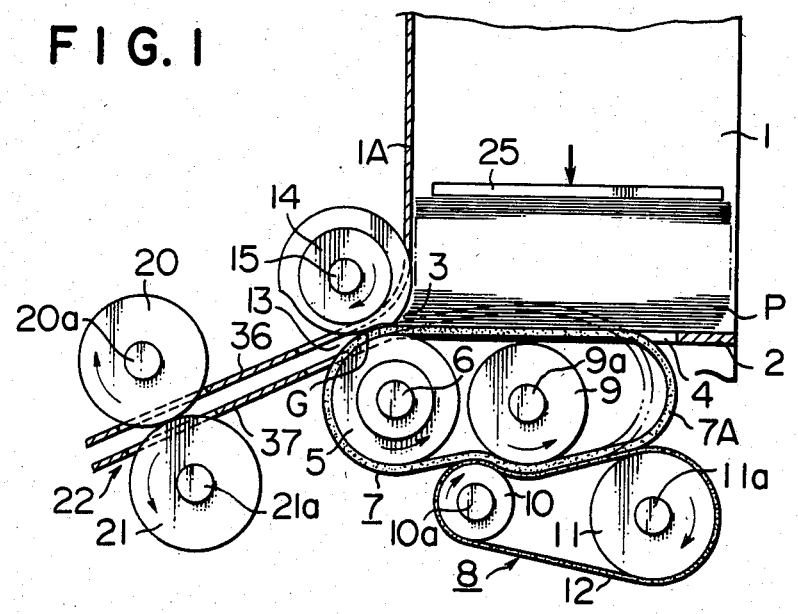
FIG. 1 is a longitudinal sectional view of a first embodiment of a delivery device in accordance with the present invention.
Figure 2:
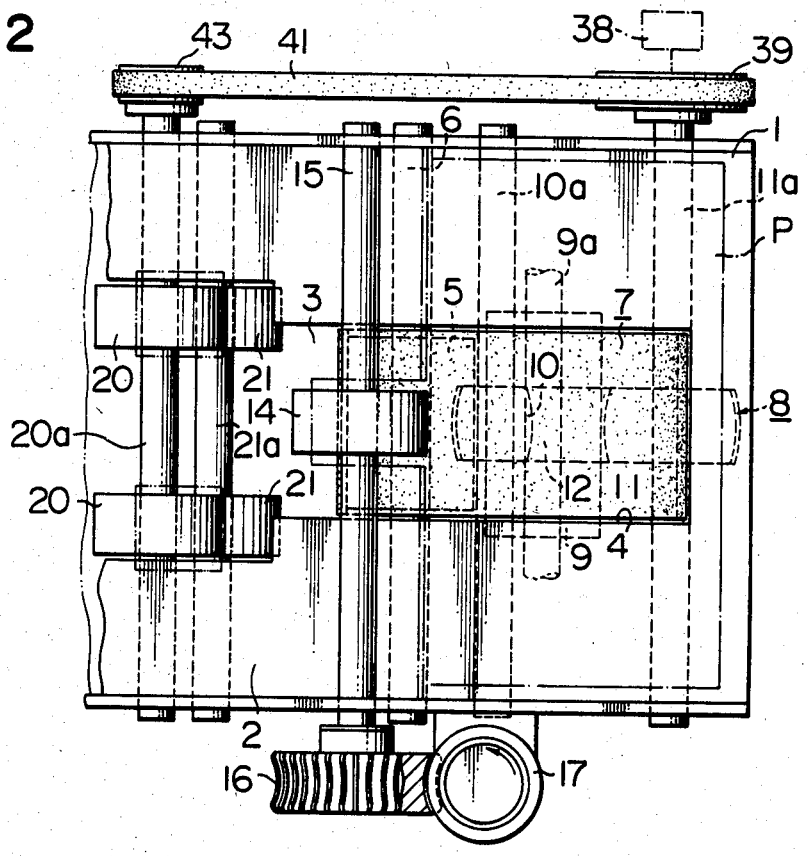
FIG. 2 is a top view thereof.

Referring to FIGS. 1 and 2, the bottom plate 2 is formed with an opening 4 which is extended from the delivery opening 3 toward its opposite side at the center portion in the direction of the width of the bottom plate 2. A rotary member 5 is disposed immediately below the delivery opening 3 and is carried by a shaft 6 through a one-way clutch in such a way that it can be rotated only in one direction. An endless belt 7 runs along the rotary member 5.

The endless belt 7 is made of a material such as rubber which is soft and has a high degree of elasticity and a high coefficient of friction. Its width is about one third of the width of a sheet and its freely deformable portion 7A extends backwardly from the rotary member 5 toward a portion adjacent to the rear end of the sheet P. The endless belt 7 has a uniform and flat outer surface. It is preferable to increase the width of the endless belt 7 as much as possible.

A belt posture holding means 8 is disposed below the endless belt 7 so that the latter assumes a predetermined posture. In this embodiment, the belt posture holding means 8 also serves as a means for driving the endless belt 7 in the direction indicated by an arrow.

The belt posture holding means 8 comprises a pulley 10 carried by a shaft 10*a* and brought into contact with an intermediate rotary member 9 spaced backwardly from the rotary member 5, a driving pulley 11 carried by a shaft 11*a* below the rear end portion of the freely deformable portion 7A of the endless belt 7 and a belt 12 running between the pulleys 10 and 11. The upper surface of the belt 12 is pressed against the lower surface of the endless belt 7 so that when there are no sheets P on the bottom plate 2, the freely deformable portion 7A of the endless belt 7 is expanded upwardly beyond the upper surface of the bottom plate 2 as indicated by the tow-dot chain lines in FIG. 1. The endless belt 7 is driven in the direction indicated by the arrow by the driving pulley 11 which rotates in the direction indicated by the arrow.

A gate forming member 14 in the form of a deformed roller is disposed above the delivery opening 3 so that a gate 13 which permits the passage of one sheet P is defined between the gate forming member 14 and the outer surface of the endless belt 7 running along the rotary member 5.

Figure 3:
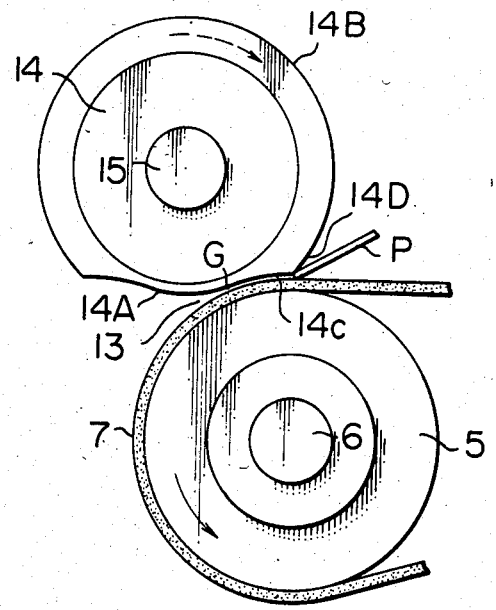
FIG. 3 is a side view, on an enlarged scale, of a gate thereof.

The gate forming member 14 may be in the form of a conventional roller having a complete circular cross section, but in this embodiment, as shown on an enlarged scale in FIG. 3, it has a small-radius portion 14A formed in the angular range of about 90° which merges with a large-radius portion 14B through arcuate portions 14C formed on the opposite side of the portion 14A. One of the portions 14C mates with the outer surface of the endless belt 7 running along the rotary member 5. The inlet to a gate slit G is defined between the outer surface of the endless belt 7 and the end portion 14D of the large-radius portion 14B which merges with the arcuate portion 14C and the gate slit G is defined between the outer surface of the endless belt 7 and the arcuate portion 14C.

Figure 4:
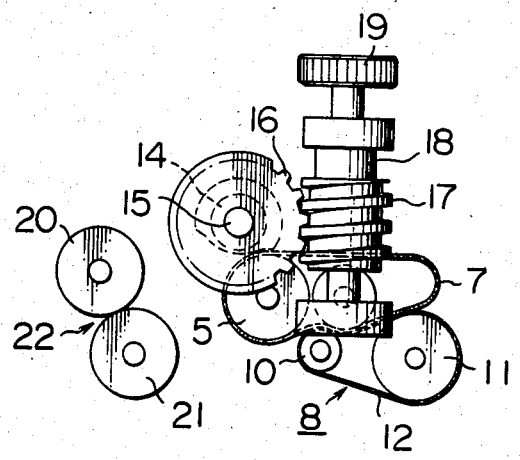
FIG. 4 is a side view of a means for adjusting a gate forming member thereof.

When the end portion 14D of the large-radius portion 14B is worn out whereby the width of the inlet to the gate slit G is enlarged, the gate forming member 14 is rotated in the direction indicated by an arrow through a suitable angle so that a new end portion 14D is brought into opposed relationship with the outer surface of the endless belt 7, whereby a predetermined inlet to the gate slit G is defined. FIG. 4 shows a means for rotating the gate forming member 14. A worm wheel 16 which is carried by a shaft 15 of the gate forming member 14 is in mesh with a worm 17. When a knob 19 attached to a shaft 18 of the worm 17 is rotated, the gate forming member 14 is rotated through a very small angle. After the gate forming member 14 is rotated to a new angular position, it can be securely held in position by means of a screw or the like.

A transport means 22 is disposed downstream of the gate 13 and spaced apart therefrom by a predetermined distance. The transport means 22 comprises a pair of symmetrically disposed driving rollers 20 and a pair of symmetrically disposed driven rollers 21. The driving rollers 20 are carried by a shaft 20*a* while the driven rollers 21 by a shaft 21*a*. A belt 41 is wound on a pulley 43 carried at one end of the shaft 20*a* and a pulley 39 carried at one end of the shaft 11*a*. The shaft 11*a* is coupled to a driving motor 38.

A guide plate 36 is extended from the lower end of the front wall 1A of the sheet container 1 and is adapted to guide the upper surface of a sheet P and a guide plate 37 which guides the lower surface of a sheet P is extended from the front end of the bottom plate 2. The pressing member 25 is placed at the top of the stack of sheets P in the sheet container 1 and presses the stack of sheets P so that the endless belt 7 assumes the position as indicated by the solid lines in FIG. 1.

In the case of the intermittent delivery in which the sheets P are intermittently delivered and spaced apart from each other by a predetermined distance, the driving rollers 20 and the driven rollers 21 which constitute the transport means 22 are driven at a velocity faster than that of the endless belt 7 as will be described in detail with particular reference to FIGS. 5(A)-(F).

Figure 5A:
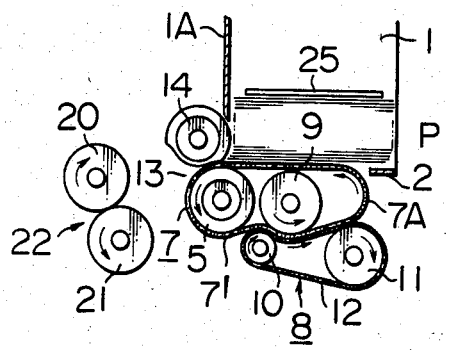
FIGS. 5(A) to (F) are views for explaining the mode of operation of the first embodiment.
Figure 5B:
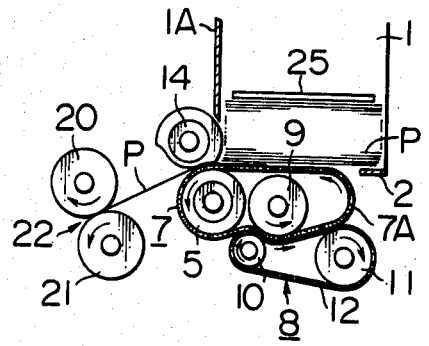

As shown in FIG. 5(A), the sheets of paper P are stacked in the sheet container 1 and are aligned with each other and the pressing member 25 is placed at the top of the stack of sheets P. As a result, the freely deformable portion 7A of the endless belt 7 which is extended upwardly through the opening 4 of the bottom plate 2 is pressed down and brought into intimate contact with the lower surface of the lowest sheet P.

In response to a delivery command, the driving pulley 11 rotates in the direction indicated by the arrow so that the pulley 10 and the belt 12 are driven in the directions indicated by the arrows, respectively. Since the endless belt 7 is clamped between the pulley 10 and the intermediate rotary member 9, the rotary member 5 and the intermediate rotary member 9 are driven through the endless belt 7 in the directions indicated by the arrows, respectively. As a result, the endless belt 7 wound on the rotary member 5 is moved while the freely deformable portion 7A assumes the posture as shown in FIG. 5(A).

When the endless belt 7 is caused to move in the direction indicated by the arrow in the manner described above, the lowest sheet P which is in surface contact with the upper surface of the freely deformable portion 7A is caused to move to the left in FIG. 5 because of the friction between the lowermost sheet P and the endless belt 7. The gate 13 stops the sheets above the lowermost sheet so that only the lowermost sheet is delivered through the delivery opening 3.

Figure 5C:
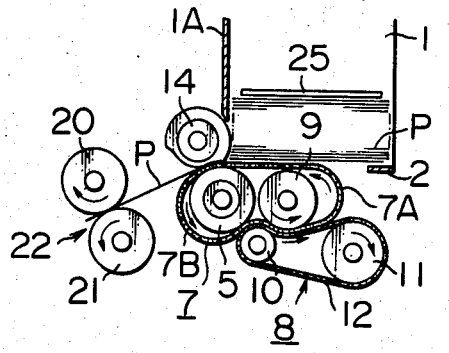

The leading edge of the sheet P thus delivered enters between the rollers 20 and 21 of the transport means 33. The driving speed of the transport means 22 is faster than that of the endless belt 7 so that the rollers 20 and 21 pull the sheet P as soon as the leading edge of the sheet P has been gripped by them. At this time, as the rear lower surface of the sheet P thus delivered is pressed against the endless belt 7, the endless belt 7 is also pulled because of the friction between the endless belt 7 and the sheet P being delivered. As a result, as shown in FIG. 5(C), the endless belt 7 follows the sheet P having been pulled by the rollers 20 and 21 while forming an arcuate slack 7B in front of the rotary member 5. In this case, the rotary member 5 is rotating at the same velocity as the endless belt 7.

Figure 5D:
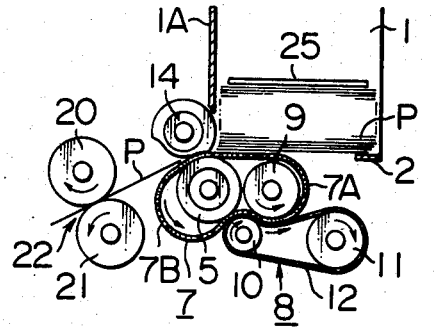

As a result, when the trailing edge of the sheet P passes through the gate 13 or when the trailing edge of the sheet P is pulled out of the bottom of the stack of sheets, the freely deformable portion 7A moves close to the intermediate rotary member 9 as shown in FIG. 5(D) so that the slack 7B becomes maximum.

Figure 5E:
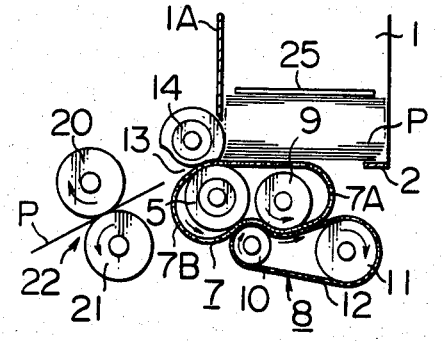
Figure 5F:
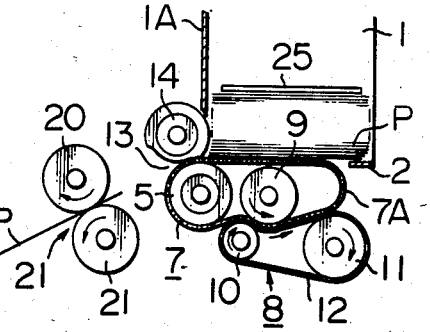

Then the trailing edge of the sheet P is pulled out of the gate 13 and delivered downstream by the transport means 22. In this case, as shown in FIG. 5(E), the lower half portion of the endless belt 7 is caused to move to the right in FIG. 5 by the driving pulley of the belt posture holding means 8 until the slack 7B is completely eliminated. At this time, the upper half portion of the endless belt 7 which is brought into contact with the lower surface of the lowermost sheet P in the sheet container 1 is maintained stationary. As a result, the endless belt 7 assumes the posture as shown in FIG. 5(F) or returns to its initial position as shown in FIG. 5(A). The rotary member 5 remains stationary from the state as shown in FIG. 5(E) to the state as shown in FIG. 5(F).

Now the sheet P pulled out of the sheet container 1 has been delivered downstream by the transport means 22 and the next sheet P is ready to enter between the rollers 20 and 21.

When the endless belt 7 returns to its initial position as shown in FIG. 5(F), the upper half portion of the endless belt 7 is caused to move in the direction indicated by the arrow by the belt posture holding means 8 so that the next sheet P is pulled out of the sheet container 1 in the manner described above. The same sequence is repeated so that the sheets P are sequentially and intermittently delivered.

The distance between the delivered sheets P can be arbitrarily selected by suitably selecting the driving speed of the transport means 22. After one sheet P has been delivered, the upper half portion of the endless belt 7 remains stationary in contact with the lowermost sheet until the slack 7B is entirely eliminated. Accordingly, the positive intermittent delivery can be assured.

As described above, as the freely deformable portion 7A of the endless belt 7 which is extended backwardly of the rotary member 5 is brought into contact with the lowermost sheet in a manner that the portion 7A can be deformed so as to pull it out of the sheet container 1, the flat surface contact between the endless belt having a delivery function and the sheet can be ensured. Furthermore, as the endless belt 7 is soft, the portion 7A can be in flexible contact with the sheets. Therefore, the reliable delivery can be ensured even when the sheets have wrinkles and creases like bank notes. Moreover, the delivery is carried out by the surface contact having a large contact area between the sheets and the belt 7 whereby the sheet transport direction is stabilized. As a result, the smooth advancement of the sheets into the gate can be ensured and jamming of sheets can be considerably reduced. Furthermore, when the transport means is driven at a faster speed as described above, the intermittent delivery can be accomplished easily and the distance between the preceding and succeeding sheets can be precisely controlled.

So far the preferred embodiment has been described in conjunction with the case in which the sheets P are stacked in the sheet container and sequentially delivered from the lowermost one, but it is to be understood that the delivery direction of the sheets of the present invention is not limited to that shown in the above embodiment and that any suitable delivery direction can be selected. For instance, the sheets may be stored in an upright position in a sheet container and pulled upwardly or downwardly out of the sheet container. So far the belt posture holding means 8 has been described as having two functions of driving the endless belt 7 and holding the posture of the endless belt 7, but it may have a single function of biasing the freely deformable portion 7A of the endless belt 7 toward a sheet P and a driving means for driving the endless belt 7 may be disposed independently of the means 8. For example, a driving roller may be disposed at the position corresponding to that of the rotary member 5 or that of the intermediate rotary member 9. The pressing means of the present invention is not limited to the pressing member 25 in the form of a plate and instead a pressure roller may be used in such a way that it keeps pressing the top of the stack of sheets as the height of the stack of sheets decreases. It is further to be understood that the construction of the gate 13 and the transport means 22 described above with reference to FIGS. 1 and 2 can be suitably modified within the scope of the present invention.

When the stored sheets are left in the sheet container 1, the delivery device of the type described has no problem, but when there is no sheet in the sheet container, there arises the problem that the outer surface of the endless belt is brought into frictional contact with the gate forming member 14. For this reason, not only the outer surface of the endless belt but also the gate forming member are worn out and consequently the gate spacing is enlarged. A second embodiment to be described below can overcome this problem.

Figure 6:
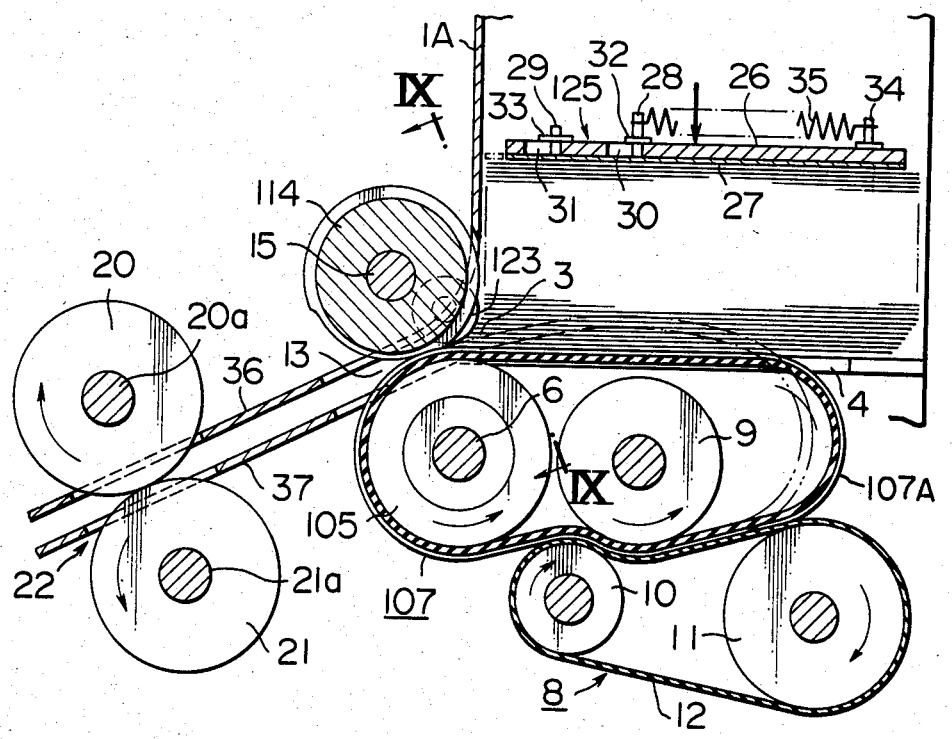
FIG. 6 is a longitudinal sectional view of a second embodiment of the present invention.
Figure 7:
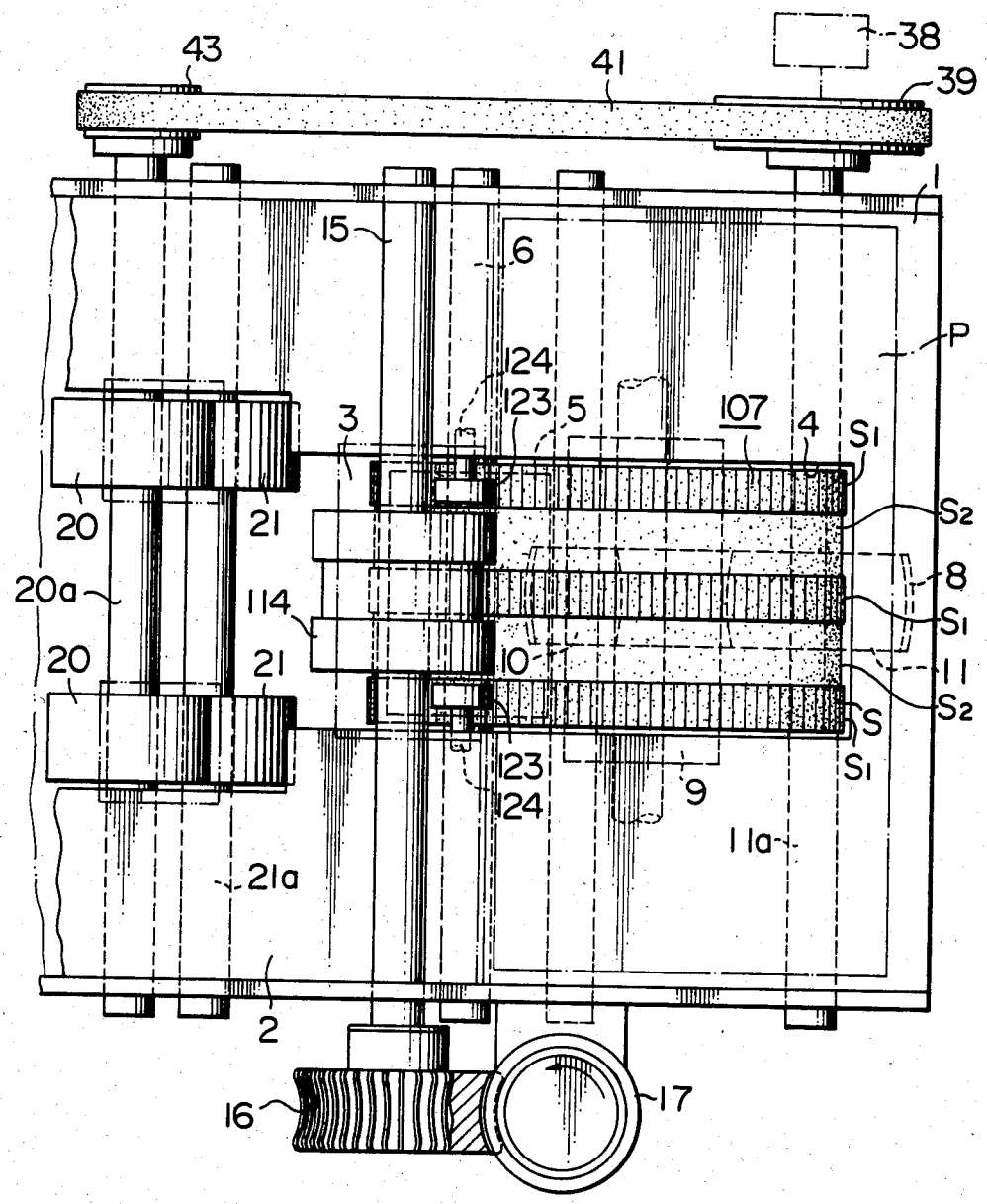
FIG. 7 is a top view thereof.

A second embodiment of the present invention is similar in construction to the first embodiment described above with reference to FIGS. 1 to 5 except that a rotary member 105, an endless belt 107, a gate forming member 114 and a pressing member 125 are different in construction from those in the first embodiment and that freely rotatable rollers 123 are disposed at the gate (FIGS. 6 and 7).

Figure 8:
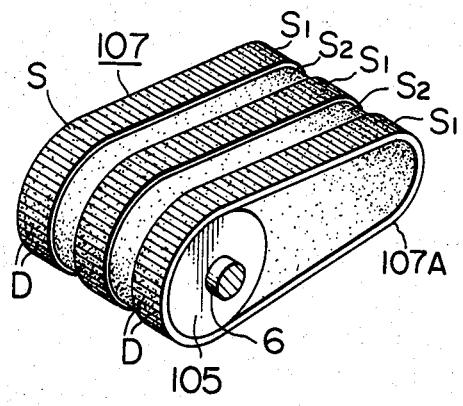
FIG. 8 is a perspective view of an endless belt shown in FIG. 6.

As best shown in FIG. 8, the endless belt 107 has outer peripheral surfaces $S_1$ which are brought into contact with the first or lowermost sheet of a stack of sheets of paper in a sheet container and a plurality (two in FIG. 8) of circumferential grooves $S_2$ which are spaced apart from each other in the transverse direction of the outer surface S of the endless belt 107. The peripheral edges of the grooves $S_2$ and the peripheral edges of the gate forming members 114 to be described below define a gate gap G. The outer peripheral surfaces $S_1$ of the endless belt 107 have a large number of transversely extended ridges and grooves D.

The gate forming members 114 are disposed above the delivery opening 3 in opposed relationship with the grooves $S_2$ on the outer surface S of the endless belt 107 so that the gate 13 for permitting the passage of only one sheet P is defined between the gate forming members 114 and the grooves $S_2$ of the outer surface S of the endless belt 107 running along the rotary member 105.

Figure 9:
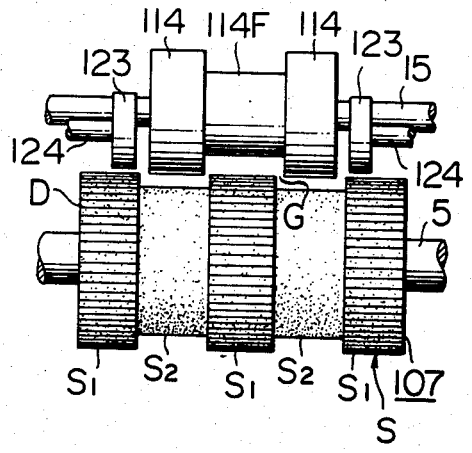
FIG. 9 is a sectional view taken along the line IX—IX of FIG. 6.
Figure 10:
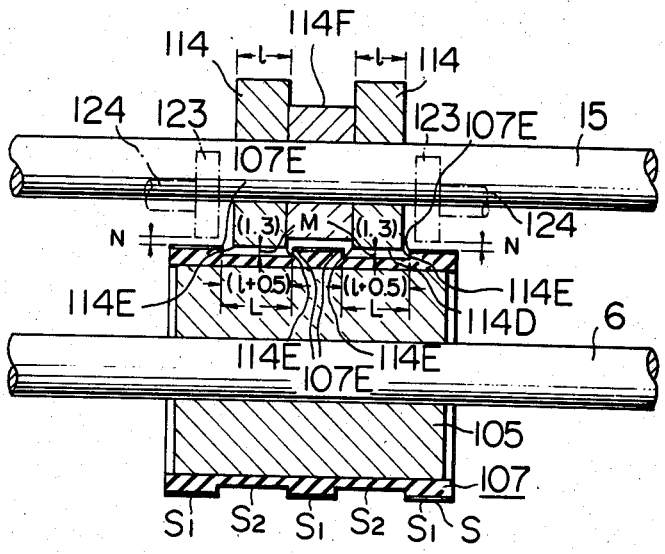
FIG. 10 is a detailed view, partly in section, of a gate.

Referring to FIGS. 9 and 10, the width L of the grooves $S_2$ of the endless belt 107 is l+0.5 mm, where l is the width of the gate forming members 114. The gap M between the bottom of each groove $S_2$ and the end portion 114D (which corresponds to the end portion 14D in FIG. 3) of the peripheral surface of each gate forming member 114 is of the order of 1.3 mm. The size of the gate gap G is dependent upon the distance between the peripheral edge 107E of each groove $S_2$ of the endless belt 107 and the opposing peripheral edge 114E of each gate forming member 114. The above-described sizes are applied to the case in which the delivery device of the present invention delivers Japanese bank notes and these sizes are suitably selected when foreign bank notes or sheets of paper other than bank notes are handled.

When the end portions 114D of the gate forming members 114 are worn out whereby the gate gap G is increased in size, a mechanism substantially similar to that described above with reference to FIG. 4 is rotated so that new end portions 114D come in opposed relationship with the grooves $S_2$ of the endless belt 107 so as to define a predetermined gate gap G. A small-diameter peripheral surface 114F is formed integral with the gate forming members 114 between them.

Figure 12:
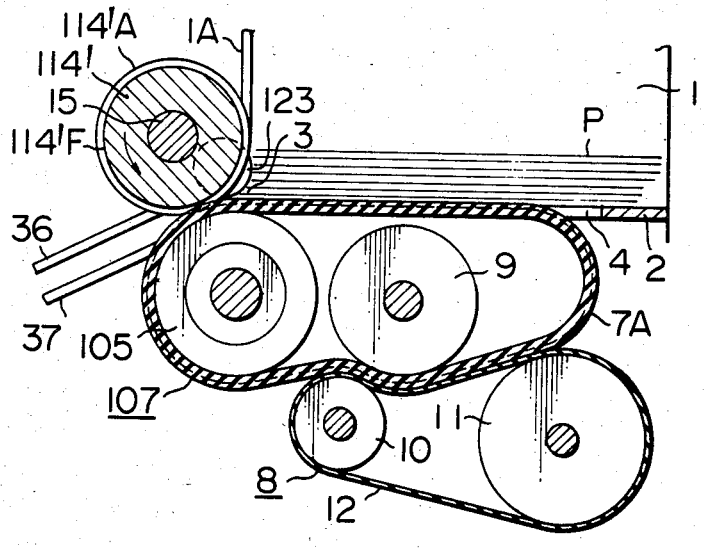
FIG. 12 is a longitudinal sectional view illustrating a modification of a gate forming member.

Referring next to FIG. 12, large-diameter outer surfaces 114' A of gate forming members 114' in the form of a complete roller are inserted into the grooves $S_2$ of the endless belt 107 and a small-diameter outer surface 114' F is in opposed relationship with the center outer peripheral surface $S_1$ of the endless belt 107.

Figure 11A:
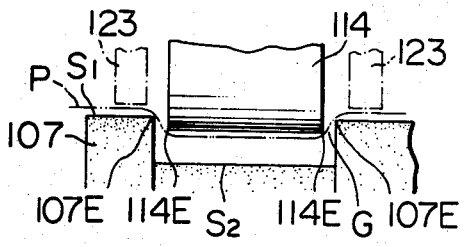
FIGS. 11(A) and (B) are views for explaining the adjustment of a gate gap.
Figure 11B:
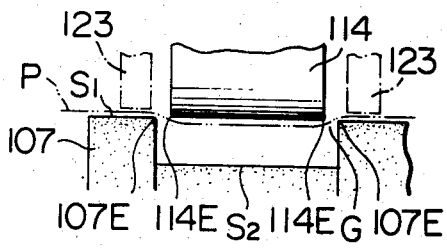

Referring back to FIGS. 6 and 9, freely rotatable rollers 123 which are carried by shafts 124 are disposed outwardly of the gate forming members 114 and the outer surfaces of the freely rotatable rollers 123 are disposed in opposed relationship with the outermost outer surfaces $S_1$ of the endless belt 107 in such a way that the condition $M>N$ is satisfied or N is about 1 mm and M is 1.5 mm (See FIG. 10). As shown in FIGS. 11(A) and (B), a sheet P is slightly bent through the gate gap G between the peripheral side edges 107E of the grooves $S_2$ of the endless belt 107 and the peripheral side edges 114E of the gate forming members 114. The gate gap G is adjusted in such a way that the gap M is adjusted. When the endless belt 107 is expanded after all the sheets have been delivered, the outer peripheral surfaces $S_1$ are brought into contact only with the cylindrical surfaces of the freely rotatable rollers 123. The gap between the center outer circumferential surface $S_1$ of the endless belt 107 and the cylindrical surface 114F is determined greater than the gap M so that the contact of the cylindrical surfaces of the freely rotatable rollers 123 and the outer circumferential surfaces $S_1$ of the endless belt 107 can avoid the contact of the end portions 114D of the members 114 and the corresponding grooves $S_2$ of the belt 117.

Referring back to FIG. 6, the pressing member 125 is placed on the top of the stack of sheets of paper P in the sheet container 1 so that the endless belt 107 is forced to maintain the state indicated by the solid lines. The pressing member 125 has a pressure body 26 and a slide plate 27 which is substantially equal in size to the pressure body 26 and is placed in contact with the lower surface of the pressure body 26. Pins 28 and 29 are respectively extended vertically through elongated holes 30 and 31 from the upper surface of the slide plate 27 and are spaced apart from each other in the direction in which a sheet is delivered out of the sheet container 1. The holes 30 and 31 are formed in the pressure body 26 and are extended in the direction in which a sheet is delivered out of the sheet container 1. These pins 28 and 29 are prevented from being pulled out of the elongated holes 30 and 31 by retaining means 32 and 33 such as nuts or retaining rings. A tension spring 35 is loaded between the pin 28 and a pin 34 provided on the rear end of the pressure body 26 and is normally maintained in the position shown. When all the sheets P are delivered out of the sheet container 1 and the slide plate 27 is brought into contact with the outer circumferential surfaces $S_1$ of the endless belt 107, the slide plate 27 moves together with the rear freely deformable portion 107A of the endless belt 107 at an instant while expanding the spring 35 and then is returned to the initial position by the repulsive force of the spring 35. Accordingly, the friction between the slide plate 27 and the endless belt 107 is decreased and consequently the wear of the endless belt 107 can be avoided.

In the case of the second embodiment shown in FIGS. 6 to 12, when all the sheets P in the sheet container 1 are delivered, the outer surface of the endless belt 107 tends to expand upwardly. However, at the gate, the outermost outer circumferential surfaces $S_1$ of the endless belt 107 are brought into contact with the cylindrical surfaces of the freely rotatable rollers 123 which are disposed in opposed relationship with the outermost outer circumferential surfaces $S_1$ and the freely rotatable rollers 123 are caused to rotate in synchronism with the movement of the endless belt 107. Therefore the endless belt 107 is prevented from contacting the gate forming members 114 and 114'. As a result, wear of the endless belt 107 and the gate forming members 114 and 114' can be avoided. At the same time, the rear freely deformable portion 107A of the endless belt 107 is brought into contact with the pressing member 125, but the slide plate 127 under the pressure body 26 of the pressing member 125 is caused to slide following the movement of the endless belt 107 whereby wear of this portion can be also prevented.

As the freely rotatable rollers are disposed laterally of the gate forming members, a sheet which passes through the gate gap can be prevented from being uselessly bent thereby to facilitate the smooth delivery of sheets.

What is claimed is:

1. A delivery device for pulling sheets of paper one at a time by the frictional contact with the foremost sheet of a stack of sheets of paper stored in registered relationship with each other and delivering the pulled out sheet to a successive device, comprising:

(a) an endless belt in contact with the surface of the foremost sheet of a stack of sheets of paper stored in registered relationship with each other;

(b) a rotary member which is disposed adjacent to the leading edge of the foremost sheet of said stack of sheets of paper and around which the front end portion of said endless belt extends;

(c) gate forming means disposed in opposed relationship with said rotary member to define a gate gap for permitting the passage of one sheet of paper between said gate forming means and the outer surface of said endless belt extending around said rotary member;

(d) means for maintaining said endless belt in a predetermined posture which forces the rear end portion of said endless belt extending around said rotary member toward the surface of the foremost sheet of paper in such a way that said rear end portion of said endless belt can be freely deformed and is brought into elastic contact with the surface of said foremost sheet of paper;

(e) driving means for driving said endless belt in the direction in which a sheet of paper is delivered; and (f) transport means disposed downstream of said gate gap for clamping and transporting the sheet of paper delivered by said endless belt;

wherein said portion of said endless belt that can be freely deformed is brought into surface contact with the surface of said foremost sheet of paper;

said transport means being driven at a velocity faster than the velocity of said endless belt so that when a sheet of paper is clamped and transported, the portion of the endless belt in the vicinity of the rotary member is driven at a faster velocity through the tail end of a sheet of paper, thereby causing the portion of said endless belt extending around said rotary member to be slacked; the slacked portion of said endless belt being displaced by said driving means and being then eliminated when the driving force imparted to said endless belt from the tail end of said sheet of paper being delivered is released; the portion of said endless belt in contact with said sheet of paper being maintained stationary when said slacked portion is being eliminated; the delivery of a sheet of paper being interrupted when said portion of said endless belt is maintained stationary, whereby the sheets of paper are intermittently delivered.

2. A delivery device as set forth in claim 1, wherein: said endless belt has a predetermined width and a plurality of belt-like outer peripheral surfaces in contact with the surface of the foremost sheet of paper and at least one gate forming groove extended along said outer peripheral surfaces; the gate forming means has a plurality of gate forming members inserted into said grooves of said endless belt, thereby forming a gate gap for permitting the passage of one sheet of paper; and freely rotatable rollers are disposed laterally of said gate forming members, respectively, and are brought into contact with said outer peripheral surfaces of said endless belt when all the sheets of paper have been delivered, whereby the contact of said gate forming members and the surface of said endless belt is avoided.

3. A delivery device as set forth in claim 1 further comprising: a pressure means for pressing said stack of sheets of paper against said endless belt; said pressure means comprising a pressure main body and a slide plate slidably mounted on said pressure main body; said slide plate being brought into contact with said stack of sheets of paper when said pressure means presses said stack of sheets of paper against said endless belt; when all the sheets have been delivered to cause said slide plate to be brought into contact with said endless belt, said slide plate being caused to slide in the direction in which said endless belt is driven, by the contact with said endless belt.

4. A delivery device as set forth in claim 1, wherein: the gate forming means comprises one gate forming member in the form of a roller having a recessed arcuate surface and said gate gap is defined between the end portion of said recessed arcuate surface and the outer peripheral surface of said endless belt.

5. A delivery device as set forth in claim 4, wherein: said gate forming member is connected to a rotating means; and when said end portion of said recessed arcuate surface is worn out, said gate forming member is rotated by said rotating means to adjust said gate gap.

6. A delivery device as set forth in claim 1, wherein: said means for maintaining said endless belt in a predetermined posture comprises a second endless belt extended along said endless belt for the delivery of the sheets; and said second endless belt is driven by a driving roller so that said means for maintaining said endless belt in a predetermined posture serves as said driving means.

* * * * *